United States Patent [19]

Schwing et al.

[11] Patent Number: 4,627,175

[45] Date of Patent: Dec. 9, 1986

[54] FLUIDIZED-BED APPARATUS

[76] Inventors: Ewald Schwing, Wiesfurther Str. 99, 4133 Neukirchen-Vluyn; Peter Sommer, Johann-Strauss-Str. 13, 4174 Issum 2; Horst Uhrner, Schumannstr. 9, 4174 Issum, all of Fed. Rep. of Germany

[21] Appl. No.: 667,283

[22] Filed: Nov. 1, 1984

[30] Foreign Application Priority Data

Nov. 5, 1983 [DE] Fed. Rep. of Germany ..... 3340099

[51] Int. Cl.[4] ..... F26B 17/10

[52] U.S. Cl. ..... 34/57 A; 34/10; 432/58

[58] Field of Search ..... 34/57 A, 57 R, 10, 232, 34/233, 224; 432/15, 58; 239/600

[56] References Cited

U.S. PATENT DOCUMENTS

| | | | |
|---|---|---|---|
| 2,651,565 | 9/1953 | Bergman | 34/57 A |
| 2,761,769 | 9/1956 | Elder | 34/10 |
| 3,282,577 | 11/1966 | Cottle | 432/58 |
| 3,552,033 | 1/1971 | Steever et al. | 34/57 A |
| 3,553,847 | 1/1971 | Kramer et al. | 34/57 A |
| 3,953,190 | 4/1976 | Lange | 34/57 A |
| 4,021,193 | 5/1977 | Waters | 34/57 A |
| 4,032,300 | 6/1977 | Parker et al. | 34/57 A |
| 4,038,758 | 8/1977 | Miller | 34/232 |
| 4,068,389 | 1/1978 | Staffin et al. | 34/57 A |
| 4,320,089 | 3/1982 | Huttlin | 34/57 A |
| 4,419,330 | 12/1983 | Ishihara et al. | 34/57 A |
| 4,443,551 | 4/1984 | Lionetti et al. | 34/57 R |
| 4,444,653 | 4/1984 | Euzen et al. | 34/57 A |

*Primary Examiner*—Albert J. Makay
*Assistant Examiner*—David W. Westphal
*Attorney, Agent, or Firm*—Karl F. Ross; Herbert Dubno

[57] ABSTRACT

A fluidized-bed assembly for the treatment of metallic and nonmetallic objects utilizes a replaceable nozzle-plate which assembly can be received within the chamber and includes an inwardly inclined side wall which is provided with nozzles in addition to those of the central portion of the nozzle-plate. The assembly can be fed with gas by pipes from above or from below.

5 Claims, 4 Drawing Figures

FLUIDIZED-BED APPARATUS

FIELD OF THE INVENTION

Our present invention relates to a fluidized-bed apparatus and, more particularly, to an arrangement for the improved introduction of a fluidizing-gas into a fluidized bed.

BACKGROUND OF THE INVENTION

In the fluidized-bed treatment of metallic and nonmetallic objects, it is a common practice to lower the objects through an upwardly open mouth of a fluidized-bed chamber into the fluidized bed turbulently maintained in this chamber, which can be of cylindrical or polygonal configuration, by introducing a fluidizing-gas, which can be air, through a nozzle plate at the bottom of this chamber.

The fluidized-bed chamber can thus have vertical chamber walls and a nozzle-plate or bottom formed with a number of gas outlet orifices and a plenum or distributing-compartment arrangement below this plate for feeding the fluidizing-gas to the orifices.

The chamber contains a fluidized bed of heat-carrying particles of a fine-grained material, e.g. ceramic or refractory substances which are fluidized by the gas which can be any treating gas.

The orifices can be discrete nozzle structures or porous plugs in appropriate openings, the different configurations of the orifices being utilized for different treatment processes and conditions.

Customarily this nozzle plate, which forms the floor of the chamber, is built into and is integral with the housing structure forming the chamber, e.g. by being welded to the side walls and any walls or the like forming the distributing compartments beneath this plate.

This causes problems when and if the nozzle plate must be replaced. This can occur when the nozzle assembly has a pressure drop which is greater than is desired for specific applications. The nozzle-plate must then be cut away from the chamber and a new nozzle-plate substituted and welded into place.

Naturally, this is a time-consuming and expensive procedure which limits the versatility of the fluidized-bed chamber because it makes it impractical to replace the nozzle-plate whenever changing conditions are confronted.

It should be appreciated that for certain treatments a stronger flow may be required in the center of the chamber than at the periphery or vice versa and, without the ability to readily replace the nozzle-plate, existing apparatus cannot be adapted to such changes in the desired operating conditions. Furthermore, prior art fluidized-bed chambers are characterized by nonhomogeneous boundary conditions in the fluidized-bed along the vertical walls of the chamber.

OBJECTS OF THE INVENTION

It is the principal object of the present invention to provide an improved fluidized-bed apparatus, especially for the treatment of metallic and nonmetallic objects, which allows the nozzle plate to be replaced or exchanged in a simple manner, which improves the fluidization characteristics and which reduces or eliminates the boundary-condition problems along the walls of the fluidized-bed chamber which have hitherto been encountered.

Another object of this invention is to provide a fluidized-bed-treatment apparatus in which poor fluidization along the vertical walls of the chamber, as characterizes at least some earlier fluidized-bed systems having vertical walls, can be rectified.

SUMMARY OF THE INVENTION

These objects and others which will become apparent hereinafter are attained, in accordance with the present invention, by providing a housing structure forming an upwardly open fluidized-bed chamber and provided with at least one vertical wall peripherally delimiting this chamber, and a floor disposed below a fluidizing compartment within this chamber, a nozzle-plate being replaceably disposed on this floor and being upwardly concave so that a gas-distributing compartment is formed below this plate which is provided with orifices opening into the fluidizing compartment.

The replaceable distributor/nozzle assembly thus comprises the nozzle-plate which defines the bottom of the fluidized-bed chamber and in turn has side walls inclined inwardly and upwardly away from the vertical wall means of the chamber and also provided with gas-distributing nozzles. These nozzles can be discrete nozzles or porous structures through which the fluidizing gas can emerge. The assembly also includes at least one gas-supply pipe opening into the space below the nozzle-plate. This gas-supply pipe can extend through the floor of the housing into this space or can communicate through the side walls of the nozzle-plate from above with this space. In the latter case, a plurality of gas-supply pipes are provided. In a preferred embodiment of the invention, the inclination of the side walls is 45° to the horizontal or vertical and, of course, the nozzle-plate can have the plan configuration of the fluidized-bed chamber.

The nozzle-plate need not be closed at the bottom of this space by a wall since the floor can serve as a wall, although it can be so closed if desired and, indeed, this is the best-mode embodiment of the invention.

With the nozzle-plate of the invention, numerous advantages obtain. Firstly, the entire distributor/nozzle assembly can be replaced simply. The distributor-nozzle assembly is mechanically and structurally independent from the fluidized-bed chamber and only need be lifted out of the latter. Its position in the chamber can be adjusted with ease. Because of the inclined side walls of the assembly, the fluidizing conditions along the vertical walls of the chamber are improved so that boundary effects which have hitherto been concerned with disturbance to the uniform fluidization are eliminated and the fluidizing conditions as a whole are more homogeneous.

Furthermore, the housing and its mechanical and thermal stresses are completely independent from those which develop in the distributor/nozzle assembly so that operational reliability is increased, wear is reduced and the versatility of the system is greatly increased.

Adjustment of the nozzle apparatus within the chamber can be effected by simple adjustment screws.

The assembly can be composed of a heat-resistant steel or even from a nonferrous material capable of withstanding the stresses and temperature conditions which apply. A ceramic material can, for example, be used.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
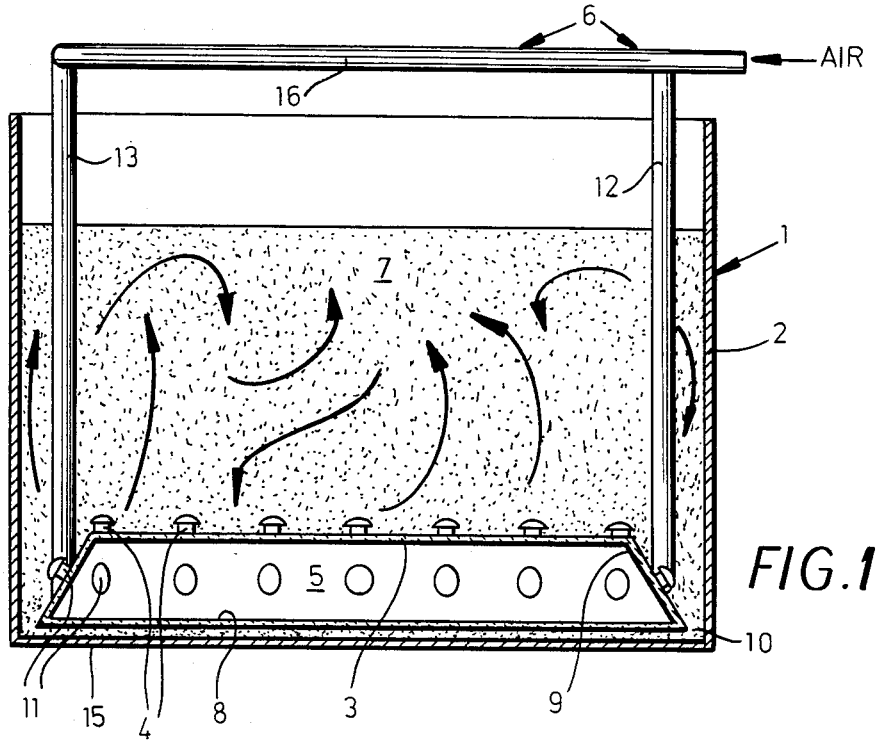
FIG. 1 is a vertical section through an apparatus for the fluidized-bed treatment of metallic and nonmetallic objects according to the invention.
Figure 2:
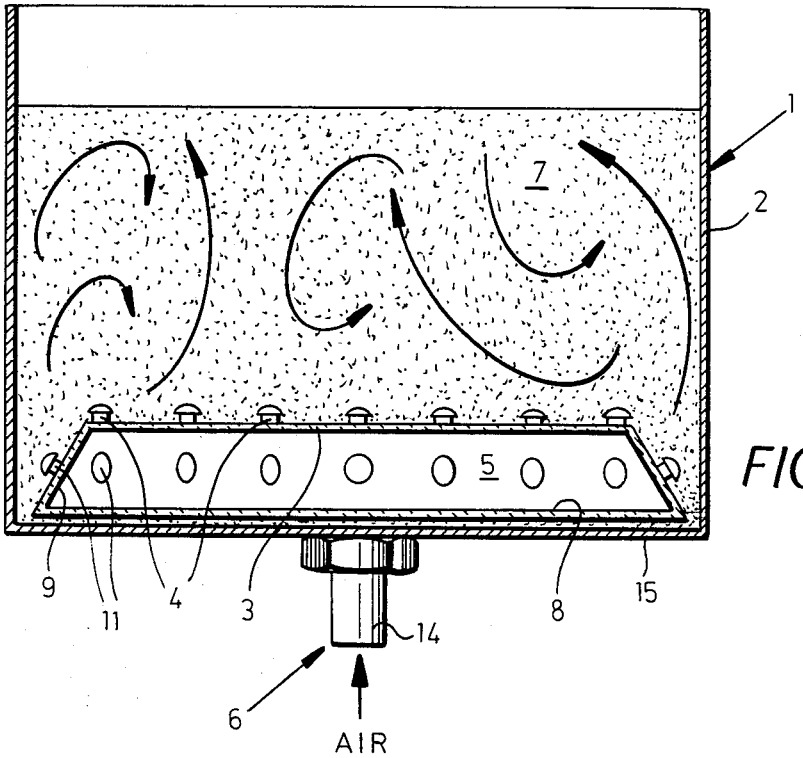
FIG. 2 is a diagrammatic section through another treatment apparatus according to the invention.

In FIGS. 1 and 2 of the drawing, we have shown an apparatus for the fluidized-bed treatment of metallic or non-metallic articles which comprises a fluidized-bed chamber 1 of round or polygonal horizontal cross section and vertical chamber walls 2. The nozzle plate 3 is provided with a multiplicity of gas-outlet nozzles 4 communicating with a distributing compartment or space 5 under the nozzle plate 3 and means represented at 6 for feeding the fluidizing gas to this space.

Figure 3:
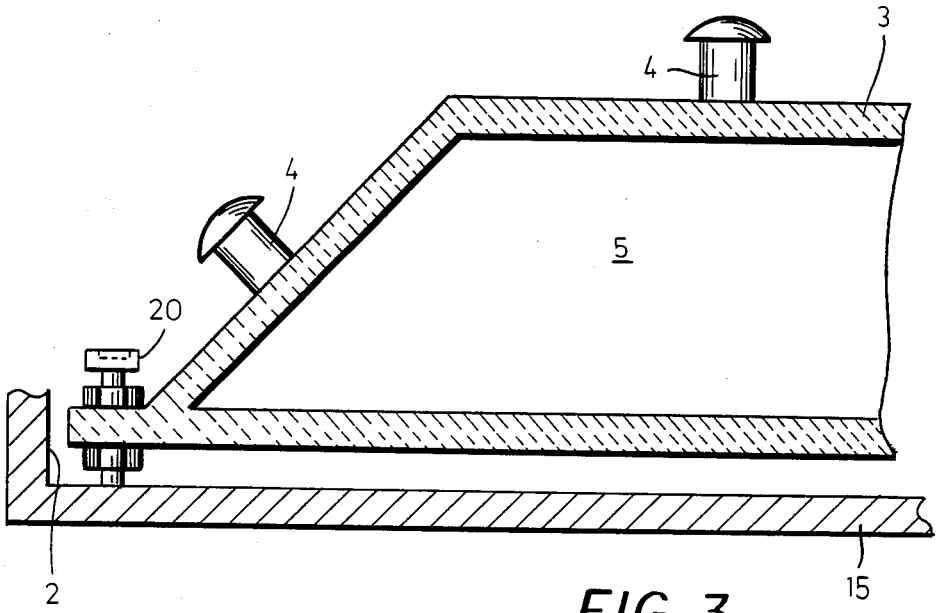
FIG. 3 is a detail section of the nozzle assembly provided with a bottom plate closing the gas-distributing space.
Figure 4:
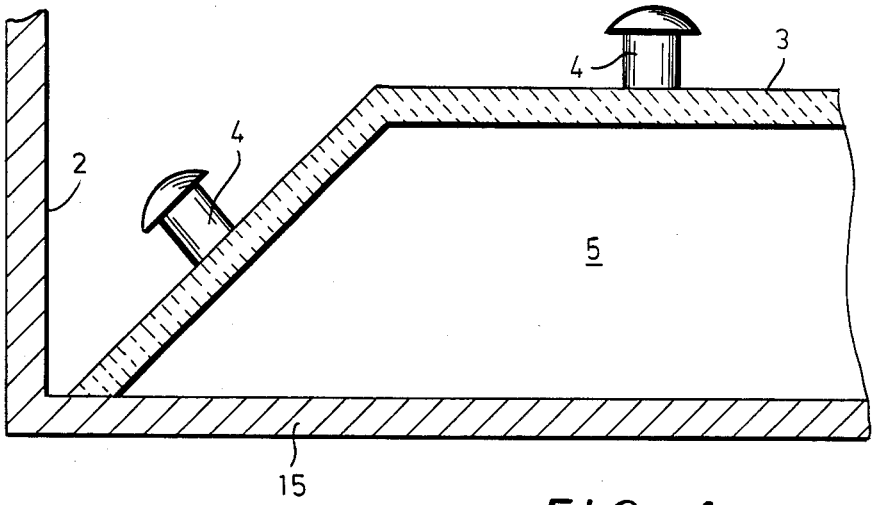
FIG. 4 is a corresponding section showing the application of the invention to an assembly which is closed at the bottom by the floor of the fluidized-bed chamber.

The fluidized-bed chamber 1 contains a filling 7 of finely divided heat-carrying particles which are fluidized by the gases emerging from the nozzles 4. The distributor-compartment 5 and the nozzle-plate 3 are replaceable as a unit or assembly 3, 4, 5 which can simply be inserted into the fluidized-bed chamber 1. The assembly then forms the bottom of the chamber and can have its own bottom wall 8 (see FIG. 3) and inclined side walls 9. When the assembly rests directly upon the floor without the presence of the bottom wall, it can be closed by the floor of the chamber (see FIG. 4) although a fully intact assembly as in FIGS. 1–3 is preferred. FIG. 3 also shows the adjusting screws 20 which can mount the assembly on the floor of the fluidized-bed chamber.

The plan configuration of the assembly 3, 4, 5 corresponds, i.e. is geometrically similar, to the plan configuration of the chamber and a clearance 10 can be provided around the assembly to allow it to be easily inserted and removed. The side walls 9 are inclined inwardly and upwardly away from the vertical walls 2 and are additionally provided with nozzles 11.

From FIG. 1 it will be apparent that the gas feeder 6 can comprise a pair of vertical pipes 12, 13 which communicate with the space 5 through the lateral walls 9 and which, in turn, are fed by the pipe 16.

A symmetrical feed of gas to the space 5 can also be effected by a single pipe 14 of the gas-feed means 6 opening into the space 5 through the floor 15 of the fluidized-bed chamber 1. In the preferred construction, the lateral walls 9 include angles with the vertical walls 2 of about 45°.

We claim:

1. In an apparatus for the fluidized-bed treatment of objects, which apparatus includes a housing having a floor and vertical circumferential wall means and defining interiorly thereof an upwardly open fluidized-bed chamber, a fluidizing-gas distributor compartment located in said fluidized-bed chamber and including a nozzle plate provided with a plurality of nozzles therethrough, and means for feeding fluidizing-gas into said fluidizing-gas distributor compartment, said nozzles serving to enable said gas to flow from said fluidizing-gas distributor compartment into said fluidized-bed chamber;

the improvement comprising that:

(a) said fluidizing-gas distributor compartment is an independent structure substantially corresponding in circumferential outline to said fluidized-bed chamber, (b) said fluidizing-gas distributor compartment has a planar top wall constituting said nozzle plate and further has peripheral side walls and a bottom wall, (c) said fluidizing-gas distributor compartment is removably positioned in said fluidized-bed chamber on said floor of said housing, and (d) peripheral side walls of said fluidizing-gas distributor compartment converge toward one another from said bottom wall and said floor to said top wall of said compartment and are provided with additional nozzles through said side walls.

2. The apparatus defined in claim 1 wherein said peripheral side walls of said fluidizing-gas distributor compartment include each an angle of about 45° with said circumferential wall means of said housing.

3. The apparatus defined in claim 1 or 2 wherein said means for feeding fluidizing-gas to said fluidizing-gas distributor compartment includes at least one feed pipe extending downwardly through said fluidized-bed chamber and communicating with said compartment.

4. The apparatus defined in claim 3 wherein each said feed pipe communicates with said fluidizing-gas distributor compartment through an associated one of said peripheral side walls thereof.

5. The apparatus defined in claim 1 or 2 wherein said means for feeding fluidizing-gas to said fluidizing-gas distributor compartment includes a feed pipe communicating with said compartment from below through said bottom wall thereof.

* * * * *